US008726619B2

(12) United States Patent
Bogle et al.

(10) Patent No.: US 8,726,619 B2
(45) Date of Patent: May 20, 2014

(54) METHODS FOR SEALING PHARMACEUTICAL VIALS

(71) Applicant: Genesis Packaging Technologies, Exton, PA (US)

(72) Inventors: F. William Bogle, Malvern, PA (US); Roger P. Asselta, South Harrison Township, NJ (US)

(73) Assignee: Genesis Packaging Technologies, Exton, PA (US)

( * ) Notice: Subject to any disclaimer, the term of this patent is extended or adjusted under 35 U.S.C. 154(b) by 0 days.

(21) Appl. No.: 13/944,242

(22) Filed: Jul. 17, 2013

(65) Prior Publication Data

US 2013/0312373 A1 Nov. 28, 2013

Related U.S. Application Data

(62) Division of application No. 13/079,175, filed on Apr. 4, 2011, now Pat. No. 8,544,665.

(51) Int. Cl.
*B65B 7/28* (2006.01)

(52) U.S. Cl.
CPC ..... *B65B 7/28* (2013.01)
USPC ..... 53/485; 53/284.5

(58) Field of Classification Search
CPC ..... B65B 7/28; B65B 7/2821; A61J 1/2096; A61J 1/1406; A61J 2001/2013; A61J 2001/2065; A61J 2001/201; A61J 2001/2071; B01L 3/50825; A61B 5/1438; B29C 45/1418; B65D 51/002; B65D 51/18; B65D 55/02; B65D 55/04; B65D 41/62; B65D 41/58; B65D 41/3442; B65D 41/3452; B65D 2251/0015; B65D 2251/009; B65D 2251/0078; B65D 47/0804; B65D 47/0838; B65D 47/122; B65D 49/00; B65D 45/32; B65D 45/34
USPC ..... 53/471, 478, 484, 485, 489, 284.5, 53/284.6; 34/284–287, 296, 242; 215/247, 215/249, 251, 258, 263, 271, 307, 309, 321, 215/355, 364
See application file for complete search history.

(56) References Cited

U.S. PATENT DOCUMENTS

| | | | | | |
|---|---|---|---|---|---|
| 4,230,231 | A | * | 10/1980 | Burnett et al. | 215/329 |
| 5,064,083 | A | * | 11/1991 | Alexander et al. | 215/247 |
| 5,085,332 | A | * | 2/1992 | Gettig et al. | 215/249 |
| 5,314,084 | A | | 5/1994 | Folta et al. | |

(Continued)

FOREIGN PATENT DOCUMENTS

EP 0909719 A1 4/1999

OTHER PUBLICATIONS

International Search Report for PCT/US2012/030513 mailed Jun. 27, 2012.

*Primary Examiner* — Hemant M Desai
(74) *Attorney, Agent, or Firm* — Caesar, Rivise, Bernstein, Cohen & Pokotilow, Ltd.

(57) ABSTRACT

A capping system and method of use for sealing injectable drugs within vials is disclosed. The system includes a closure assembly and a locking cap. The closure assembly includes a retainer member and a resilient stopper located within the retainer member. The retainer member is arranged to be disposed on the vial whereupon a gap results between the stopper and the vial. The retainer member is movable to close that gap. The locking cap is used to permanently seal the vial.

10 Claims, 4 Drawing Sheets

(56) References Cited

U.S. PATENT DOCUMENTS

| | | | | |
|---|---|---|---|---|
| 5,429,256 | A | 7/1995 | Kestenbaum | |
| 5,718,348 | A | 2/1998 | Manera | |
| 5,803,284 | A * | 9/1998 | Grimard | 215/249 |
| 5,819,964 | A | 10/1998 | Grimard | |
| 6,619,499 | B1 * | 9/2003 | Lin | 220/371 |
| 6,792,743 | B2 * | 9/2004 | Odell et al. | 53/452 |
| 7,467,482 | B2 * | 12/2008 | Yarborough et al. | 34/287 |
| 2005/0086830 | A1 * | 4/2005 | Zukor et al. | 34/443 |
| 2006/0134354 | A1 * | 6/2006 | Walters et al. | 428/34.1 |
| 2007/0102393 | A1 * | 5/2007 | Colin et al. | 215/249 |
| 2007/0272648 | A1 | 11/2007 | Hamamoto et al. | |
| 2010/0089862 | A1 | 4/2010 | Schmitt | |
| 2010/0224632 | A1 | 9/2010 | Aneas | |
| 2011/0068106 | A1 * | 3/2011 | Zukor et al. | 220/367.1 |
| 2013/0205719 | A1 * | 8/2013 | Wensley et al. | 53/408 |
| 2013/0240476 | A1 * | 9/2013 | Aneas | 215/320 |

* cited by examiner 26A
26E
26D
26E
26D
26E
24
26

26G
26A
26C
26F
26D
26E
24
26D
26G 24A
24
24B
24C
24D
24E 26G
26B
26E
26F
26A
26C
26F
26D
26G
26E
26F 26G
26F
26B
12
10
14
8
30
22
26A
26C
26
26G
26F
24
6
2
4

26B
26G
10
14
26F
22
26
26F
24
6
4

METHODS FOR SEALING PHARMACEUTICAL VIALS

CROSS-REFERENCE TO RELATED APPLICATIONS

This divisional application claims the benefit under 35 U.S.C. §121 of application Ser. No. 13/079,175, filed on Apr. 4, 2011, now U.S. Pat. No. 8,544,665, issued on Oct. 1, 2013, the contents all of which are incorporated herein by reference.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to container capping systems and more particularly to systems and methods for capping pharmaceutical vials.

BACKGROUND OF THE INVENTION

For more than sixty years injectable drugs have been packed in glass vials. Such vials typically are formed of glass and have a cylindrical neck terminating in a flanged top or lip, with the opening to the interior of the vial extending through the neck. The neck is sealed by means of a rubber stopper and an aluminum seal or ferrule. When these types of vials are used in lyophilization (freeze drying) the vial is filled with liquid and then the stopper (which is a complex or complicated elastomeric member) is inserted part way into the vial so that the product can be lyophilized. In this regard, the standard stopper and vial combination often rely on a feature called a "blowback" on the inside of the vial's lip to mate with an indentation on the elastomeric stopper. This action keeps the stoppers from rising up during processing. Once the lyophilization process has occurred the stopper is then fully seated in place, e.g., pushed down, so that it is completely within the neck of the vial during the final stages of the process and a ferrule applied to lock the stopper in place to thereby permanently seal the vial. Needless to say this is a complex operation and requires that the entire operation be accomplished within sterile conditions, e.g., within the freeze drying apparatus. Moreover, the construction of the closures require the use of vials having the blowback feature, thereby limiting the materials that can be used to form the vials to glass, e.g., plastic materials have not proved economically viable for producing vials with a viable blowback feature.

Accordingly, a need exists for a capping system, particularly one that is suitable for lyophilization applications, which overcomes the drawbacks of the prior art.

The subject invention addresses that need.

SUMMARY OF THE INVENTION

In accordance with one aspect of the invention there is provided a cap system for sealing a pharmaceutical vial having an opening to the interior of the vial and a flanged neck surrounding the opening, the flanged neck having an undersurface. The cap system comprises a closure assembly (e.g., a pre-assembled unit) having an elastomeric stopper and a retainer member. The elastomeric stopper has a body portion. The retainer member includes a top wall and a peripheral sidewall. The sidewall comprises plural resilient fingers that are located about the periphery of the sidewall. The stopper is arranged to be secured to the vial so that the body portion of the stopper partially closes the opening of the vial. The retaining member is arranged to be secured to the vial with its fingers arranged to flex over the flanged neck of the vial and then to snap into engagement with the undersurface of the flanged neck of the vial. Portions of the top wall of said retainer member are then in engagement with portions of the stopper to hold the stopper in place (e.g., slightly compress the stopper) on the vial to seal the opening in the vial.

In accordance with one aspect of this invention the vials using the closure of the foregoing cap system can be readily used for in-vial lyophilization of pharmaceuticals within a freeze drying apparatus to temporarily seal the contents within the vial. The then the closures on the vials can be permanently sealed (i.e., the temporary seal locked) by means of a locking member, also forming an aspect of this invention. The locking member can be applied at any other location, even a non-sterile location.

In accordance with another aspect of this invention method for capping plural pharmaceutical vials is provided. Each vial includes an interior in which a lyophilizable material is located, with the vial having an opening to the interior of the vial and a flanged neck surrounding the opening. The flanged neck has an undersurface. The method basically entails providing a plurality of such pharmaceutical vials in a tray. Each vial is provided with a respective closure assembly comprising an elastomeric stopper and a retainer member on the neck of its associated vial so that a portion of the stopper partially closes, but does not seal, the opening of the vial (e.g., moisture can pass through a gap or interface between the stopper and the immediately adjacent portion of the neck of the vial). A waterproof/breathable fabric membrane, e.g., Gore-tex® fabric, cover is disposed over the vials within the tray to enclose the vials with their respective closure assemblies within the tray and the tray with the vials and cover is placed in a freeze drying chamber to lyophilize the contents of the vials, whereupon the moisture extracted from within the vials passes through the membrane cover out of the tray (e.g., moisture passes through the interface between the stopper and neck of the vial and through a communicating slot in the retainer member). A force can then be applied to the closures within tray after the contents of the vials have been lyophilized to cause the retainer member to snap-fit on the flanged neck of the associated vial so that portions of the associated stopper seal the opening in the associated vial (e.g., a fluid-tight fit is produced at the interface of the stopper and the neck of the vial).

The tray with the sealed lyophilized vials can then be removed from the freeze drying chamber for further processing, if desired. To that end, and in accordance with another method aspect of this invention after the tray with the sealed lyophilized vials has been removed, the vials can be removed from the tray or left in the tray but taken to a different location for further processing. That further processing can consist of securing a locking member over the closures to form a permanent seal for the vials.

Figures 1, 2, 3, 4, 5, 6:
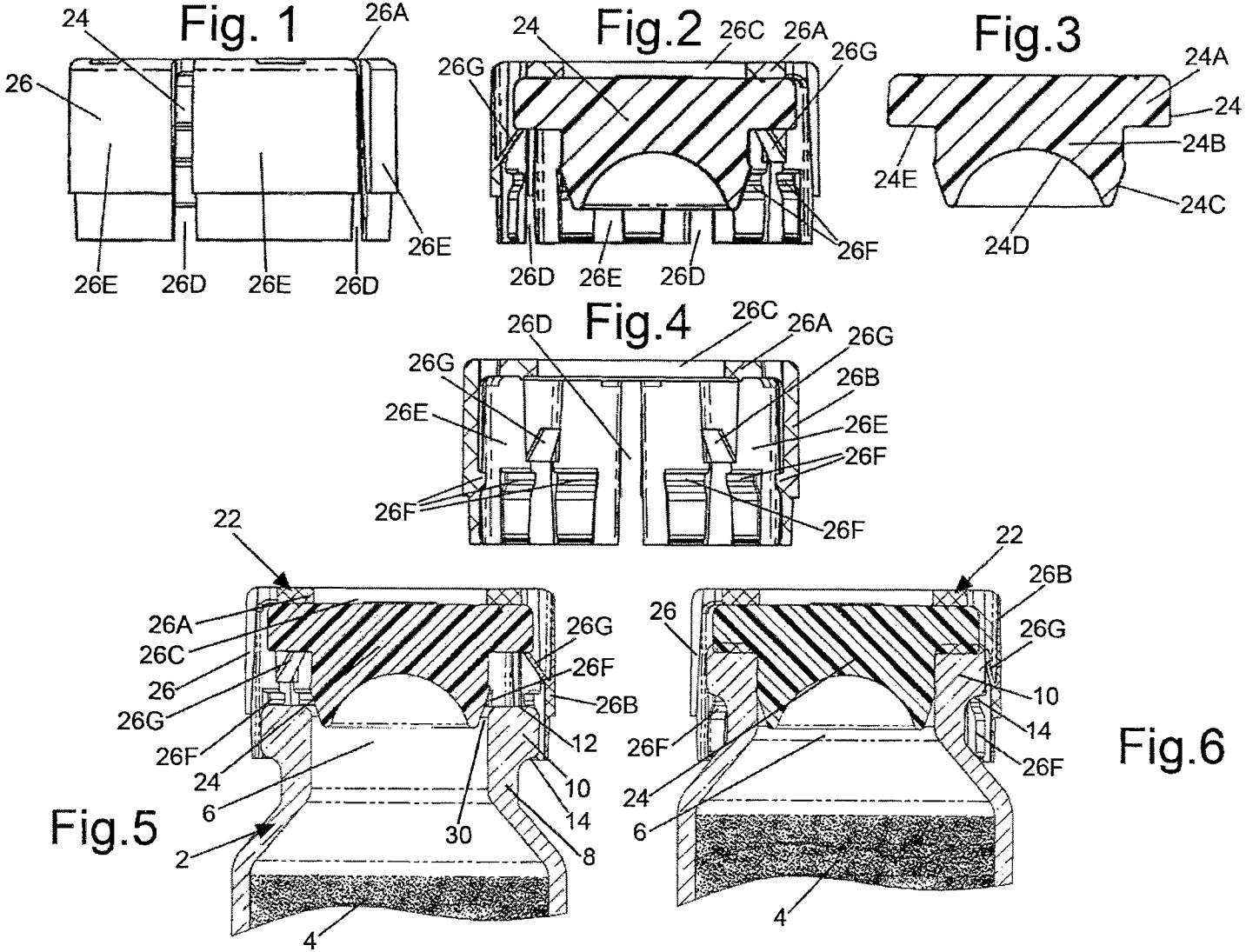
FIG. 1 is a side elevation view of one exemplary embodiment of pre-assembled closure assembly forming one aspect of a capping system constructed in accordance with the subject invention, with the closure assembly being particularly suited for use on a pharmaceutical vial, e.g., a glass vial for an injectable drug.
FIG. 2 is a vertical cross-sectional view of closure assembly of FIG. 1.
FIG. 3 is a vertical cross-sectional view of a stopper member forming a portion of the closure assembly of FIGS. 1 and 2.
FIG. 4 is a vertical cross-sectional view of a retainer member forming a portion of the closure assembly shown in FIGS. 1 and 2.
FIG. 5 is a vertical cross-sectional view of the closure assembly shown in FIGS. 1 and 2 after it has been initially placed on a vial holding an injectable drug to temporarily seal the vial.
FIG. 6 is a view similar to FIG. 5 but showing the closure assembly after it has been used to temporarily seal the vial.
Figures 12, 13, 14, 15, 16, 17, 18:
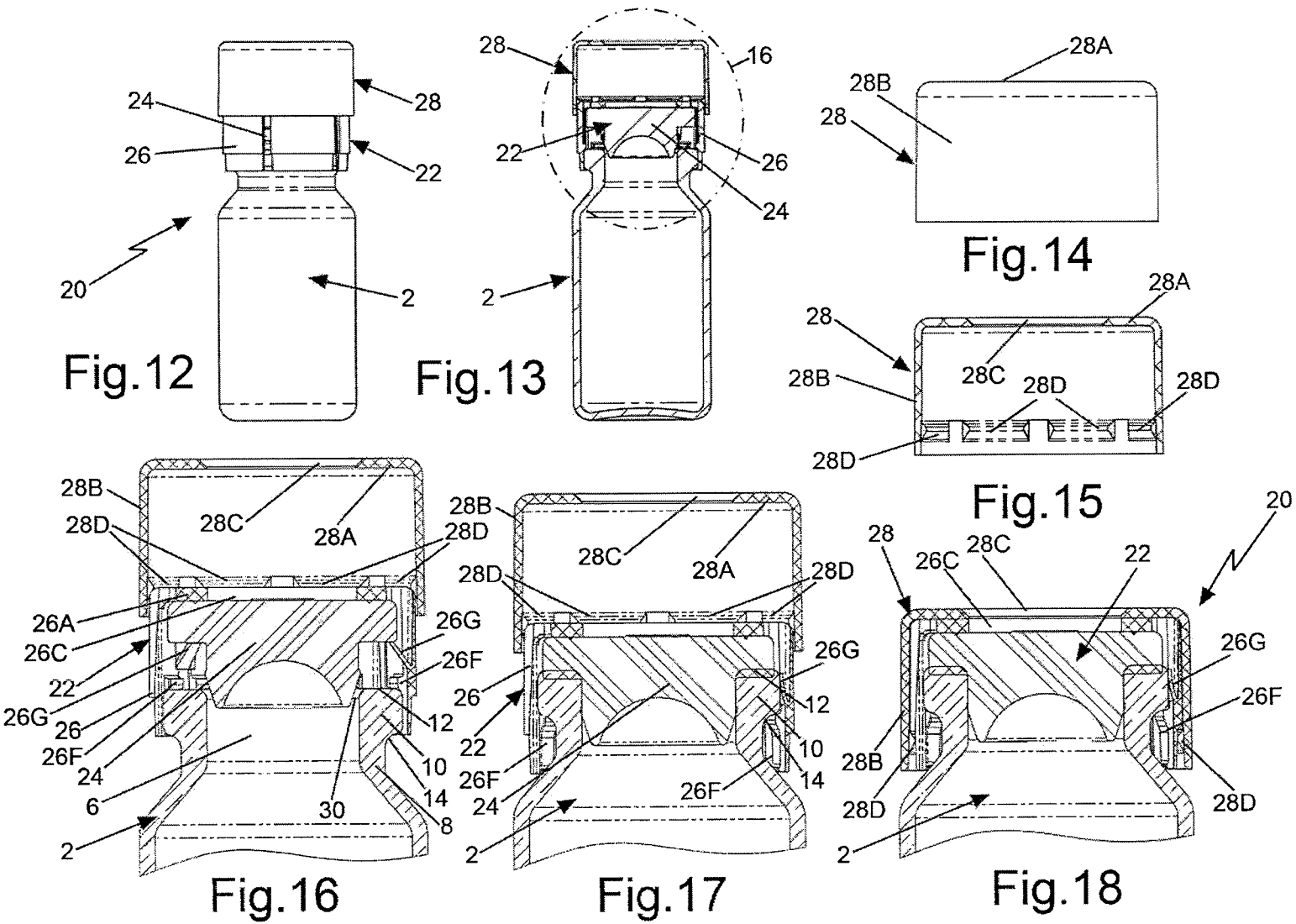

7;

FIG. 12 is a side elevation view of an alternative embodiment of a capping system constructed in accordance with this invention shown in place on a vial and arranged to seal the vial, the capping system of this embodiment comprising a closure assembly like that shown in FIG. 1 and a locking cap member (shown in FIGS. 14 and 15) for permanently sealing the vial;

FIG. 13 is a vertical cross-sectional view of embodiment of the capping system shown FIG. 12;

FIG. 14 is a side elevation view of the locking cap member shown in FIG. 12;

FIG. 15 is a vertical cross-sectional view of the locking cap member shown in FIG. 14;

FIG. 16 is an enlarged vertical cross section view of the portion of the portion of the capping system shown within the oval designated "16" in FIG. 13, wherein the capping system is at an initial position for use;

FIG. 17 is a vertical cross section view, similar to FIG. 16, but showing the capping system at an intermediate point in its use to effect the temporary sealing of the vial; and FIG. 18 is a vertical cross section view similar to FIGS. 16 and 17, but showing the capping system after it has been fully secured to the vial to effect the permanent (long term) sealing of the vial.

DETAILED DESCRIPTION OF THE PREFERRED EMBODIMENT

Referring now to the various figures of the drawing wherein like reference characters refer to like parts, there is shown in FIG. 1 one exemplary embodiment of a closure assembly 22 forming one component of a capping system 20 constructed in accordance with one aspect of this invention. The closure assembly 22 is shown in FIGS. 1-4 and basically comprises a resilient (e.g., elastomeric) stopper 24 and a retainer member 26 and is arranged to be secured to a vial to temporarily seal it as shown in FIGS. 5-6. Another component of the overall capping system 20 is in the form of a locking cap member 28, which is arranged to cooperate with the closure assembly 22 to permanently seal of a vial as shown in FIGS. 16-18. Thus, the entire closure assembly 20 includes an inner closure assembly 22, which can be used by itself, as will be described later with reference to FIGS. 5, 6-11, or can be used in combination with the locking cap member 28 after the inner closure assembly has been applied to the vial.

The closure assembly 22 or the entire capping system 20 of this invention are particularly suitable for use on pharmaceuticals vial, such as a glass vial 2 used for injectable drugs, but owing to the construction of the closure assembly it/they can also be used on vials made of plastic. Before describing the details of the closure assembly 22 and the locking cap member 28 a brief description of the vial on which they can be used is in order. To that end, as best seen in FIGS. 5 and 6, the exemplary vial shown basically comprises a hollow body in which a pharmaceutical 4 or other drug or other product to be held in a sterile state is located. The entrance to the interior of the vial's body is provided via an opening 6 extending through a neck 8 of the vial. The top of the neck of the vial is in the form of a lip or flange 10, having a generally planar top surface 12 and a somewhat undercut surface 14. Due to the construction of the capping system the interior surface of the opening 6 in the neck of the vial need not include a blow-back annular recess, as has characterized prior art vials. Thus, the capping system of this invention enables one to use simpler vials than existing prior art glass vials. In fact, the subject invention enables one to use vials made of plastics as well.

The details of the inner closure assembly 22 will now be described. To that end, as can be seen best in FIG. 3 the resilient, e.g., rubber, stopper member 24 comprises a disk-like body 24A from which a plug 24B projects. The outer surface of the free end of the plug is tapered at 24C to facilitate its entrance into the opening 6 in the vial. The distal surface of the plug includes a hemispherical recess 24D to provide some give to also facilitate entry of the plug into the vial opening. The periphery of the disk-like body 24A is in the form of a flange having a generally planar undersurface 24E. The central portion of the stopper is arranged to be pierced by a needle, syringe, catheter or some other instrument to provide access to the contents of the vial.

The retainer member 26 is of a general cup-like shape and can be formed of any suitable plastic material, e.g., polypropylene, that is sufficiently strong, yet having some flexibility (for reasons which will be apparent later). The retaining member 26 can be molded as an integral unit and basically comprises a top wall 26A and a peripheral sidewall 26B. The center portion of the top wall is open at 26C to provide access to the stopper so that a needle or other piercing device can be inserted therethrough. The peripheral sidewall 26B includes a plurality of slots 26D equidistantly spaced from one another. The portions of the sidewalls between the slots 26D form respective, downwardly extending flexible talons or fingers 26E. As best seen in FIG. 4 at least one (and preferably two) internal lugs 26F projects inward from the inner surface of each of the fingers 26E. The lugs are located slightly above the bottom edge of the retaining member 26. Each finger 26E also includes a flexible tab 26G extending inward and upward from the inner surface of the associated finger. The tabs 26G are arranged to flex inward so that the stopper 24 can be inserted and held within the retaining member, with the top surface of the stopper abutting the undersurface of the top wall 26A. The tabs 26G then snap back into place to engage the undersurface 24E of the stopper and thereby hold the stopper in place as shown in FIG. 2. Thus, the closure assembly can be readily preassembled to the state shown in FIG. 2, whereupon it is ready for use to be secured to a vial 2.

That operation is best seen in FIGS. 5 and 6. In particular, the closure assembly 22 is arranged to be placed on the neck of a vial so that the top surface 12 of the vial's neck abuts the inwardly projecting lugs 26F of the retainer member 26 as shown in FIG. 5. In this position the distal end 24C of the plug portion of the stopper 26 is located within the opening 6 of the vial. In this position there will be a slight gap or open interface 30 between the outer surface of the distal end of the stopper and the inner surface of neck of the vial. Moreover this gap will be in fluid communication with the slots 26D and hence to the ambient atmosphere. This feature provides an important function to enable the lyophilization of the pharmaceutical 4 within the vial (as will be described later). In order to close the interface 30 and thus temporarily seal the vial, all that is required is to apply a downward force on the retaining member to cause its fingers 26E to flex outward to ride over the flanged lip of the neck of the vial, so that the top surface of the inwardly projecting lugs snap into place to engage the undersurface 14 of the neck of the vial as shown in FIG. 6. Moreover the tabs 26G ride over and tightly engage contiguous portions of the lip of the vial. This action traps the closure assembly on the neck of the vial and slightly compresses, e.g., 20% compression, the peripheral flange of stopper 24 between the top wall of the retainer member and the top surface of the neck of the vial, whereupon the drug contents in the vial are sealed off from the ambient atmosphere.

As will be appreciated by those skilled in the art, the foregoing operation is suitable for sealing vials with liquid drugs under sterile conditions. For applications in which the drug is to be lyophilized (freeze-dried), a plurality of filled vials 2 can be provided with respective closure assemblies 22 and placed within a specially constructed pre-sterilized tray assembly 100 in a sterile freeze drying chamber. The vials are filled in rows without leaving the trays.

Figure 7:
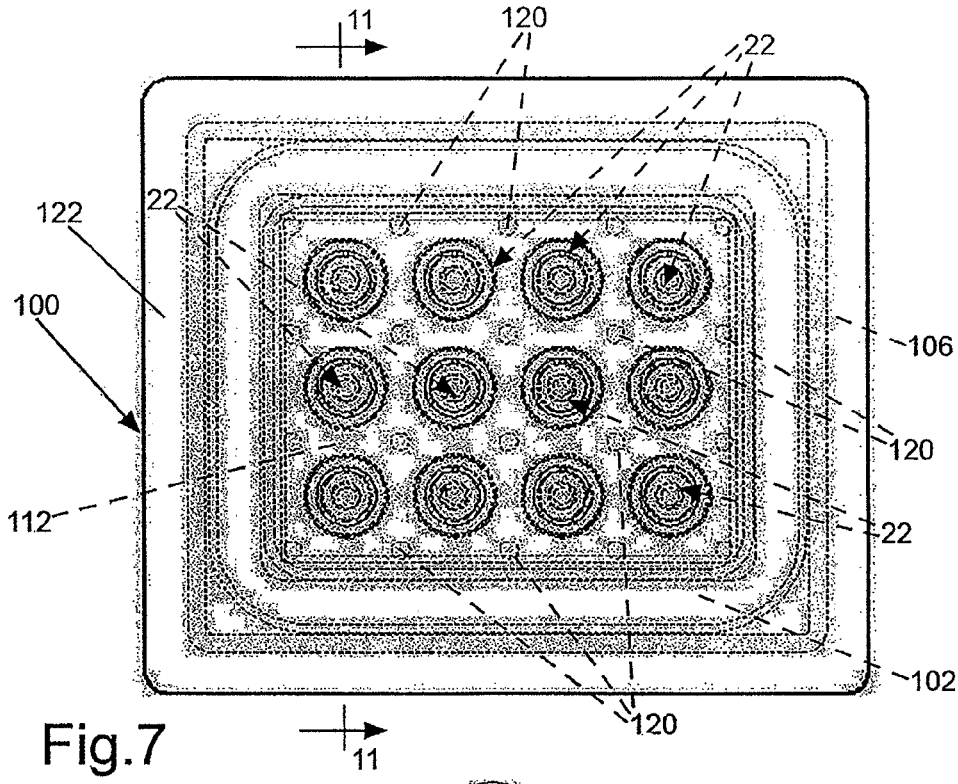
FIG. 7 is a top plan view of apparatus used for sealing a plurality of vials, like shown in FIG. 5 with closure assemblies like shown in FIGS. 1-4, in accordance with one exemplary method of this invention, e.g., lyophilizing pharmaceuticals within those vials.
Figure 8:
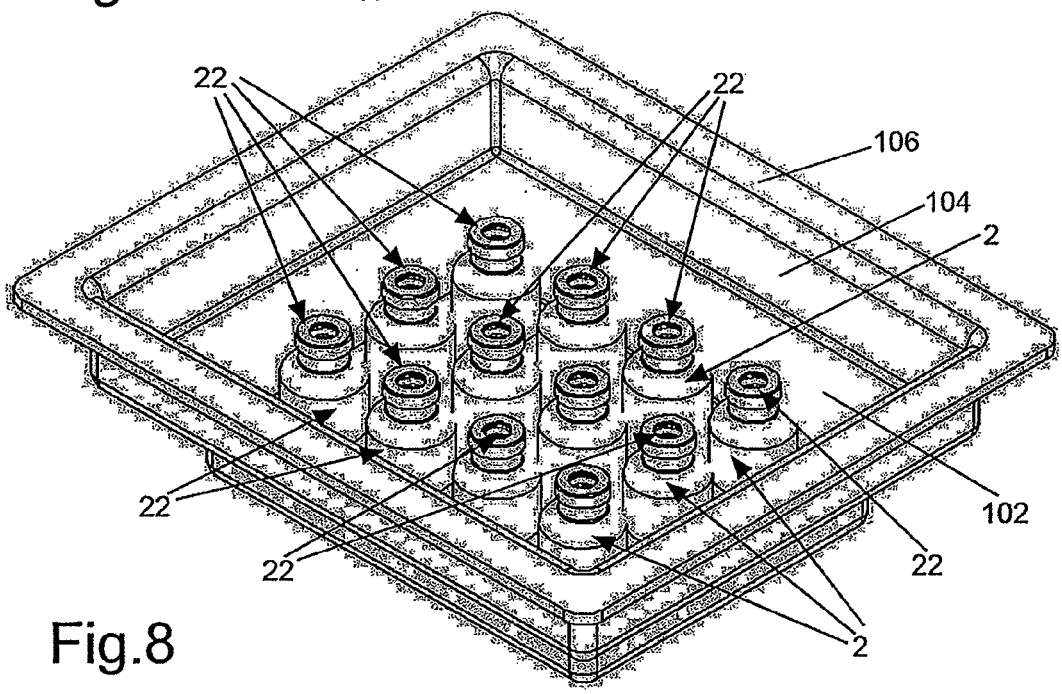
FIG. 8 is an isometric view of a portion of the apparatus shown in FIG. 7 with a plurality of vials in it ready to be capped with a capping system and method of use in accordance with this invention.
Figure 9:
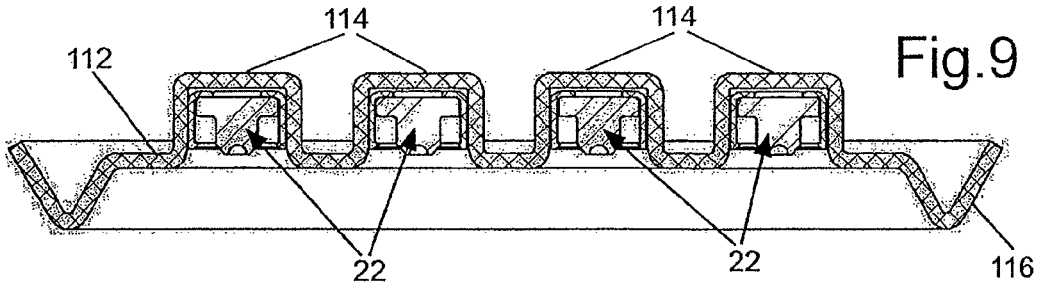
FIG. 9 is a slightly enlarged cross sectional view of a portion of the apparatus shown in FIG. 7 for capping the vials in the apparatus.
Figure 10:
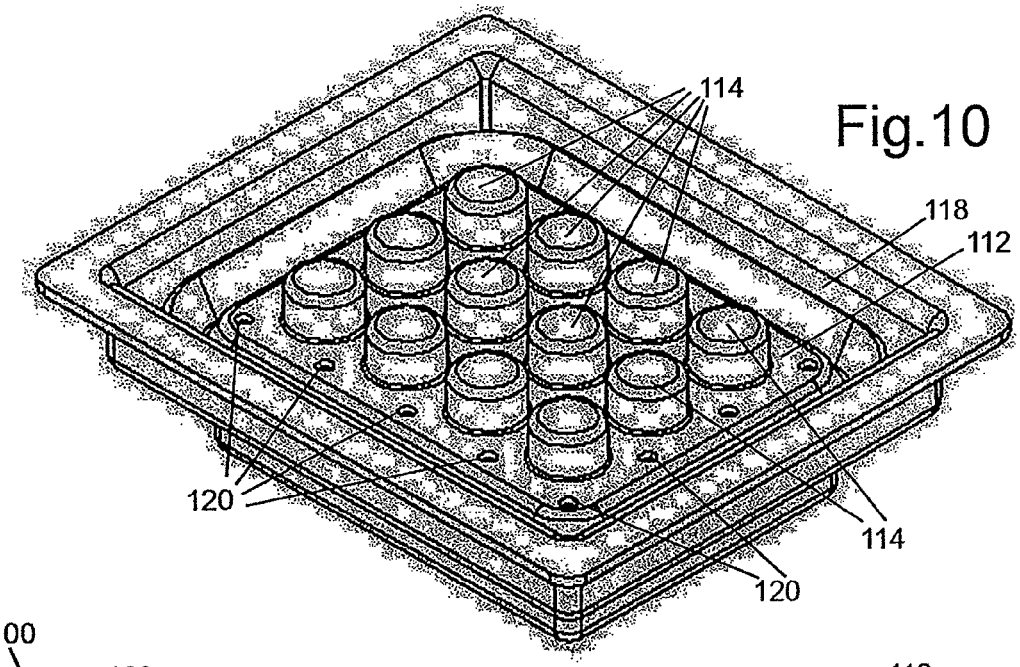
FIG. 10 is an isometric view of a portion of the apparatus of FIG. 7.
Figure 11:
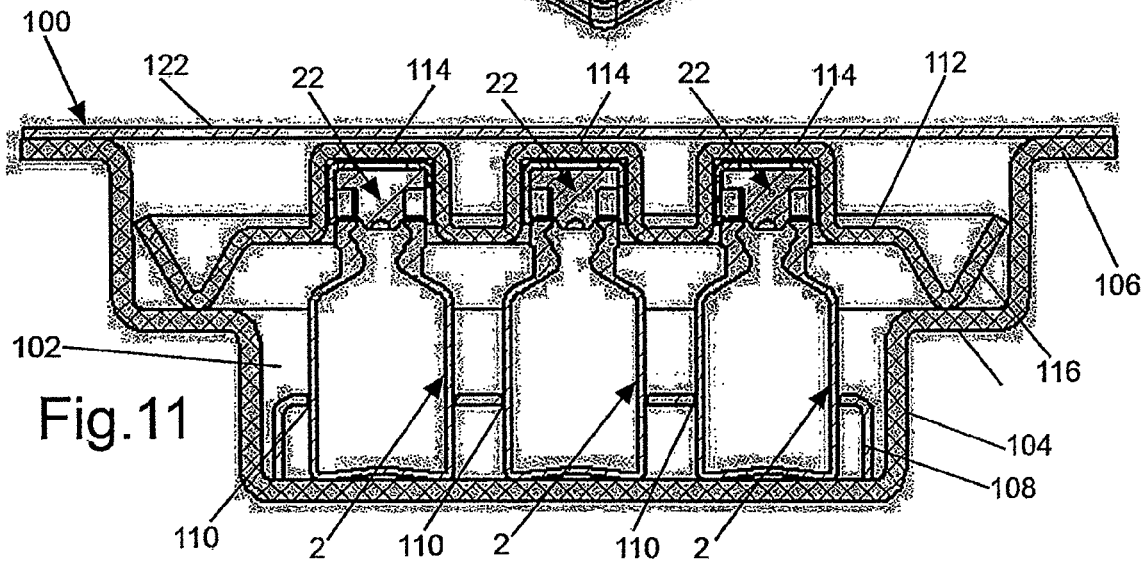
FIG. 11 is an enlarged vertical cross sectional view taken along line 11-11 of FIG.

FIG. 7 shows a top view of an exemplary tray assembly. It basically comprises a hollow base member of a general tray-like shape having a bottom wall 102 and a peripheral sidewall 104. The upper surface of the sidewall 104 is in the form of a generally planar flange 106. A holder 108 having an array of openings 110 therein is located within the tray, with each opening being arranged to receive a respective one of a filled vial 2 as shown in FIG. 11 so that the vials are disposed in a spaced array. A cover member or upper tray 112, is provided and is best seen in FIGS. 9-11 to hold the closure assemblies. To that end, it includes a plurality of downward facing recesses 114 spaced from one another by the same spacing as the vials in the array of the holder 108. Each recess is arranged to hold a respective closure assembly 22. The outer periphery of the upper tray 112 includes a generally V-shaped projection 116 which is arranged to be disposed on a ledge 118 of the sidewall 104 of the bottom tray so that each vial 2 has a respective closure assembly disposed above and axially aligned with it as best seen in FIGS. 10 and 11. The upper tray also includes a plurality of apertures or vent holes 120.

Once the upper tray with the preassembled closure assemblies has been placed in the lower tray so that each vial in the array has a respective closure assembly disposed immediately above it, a moisture permeable (e.g., waterproof/breathable) membrane 122, e.g., a sheet of Gore-tex® membrane, is disposed over the tray and secured, e.g., heat sealed, to the flange 106 of the lower tray as best seen in FIG. 11. This action effectively seals the lower tray with the vials and closure assemblies therein. The contents of the vials are now ready to be freeze dried in place. To that end, with the closure assemblies on each vial in the position shown in FIG. 5 and the tray in a sterile freeze drying chamber the freeze drying processes can begin. In fact plural trays can be stacked within the freeze drying chamber. In any case the lyophilization action evacuates any liquid within the vials through the slightly open interface 30 in each vial and from there through the apertures 120 in the upper tray and out into the freeze drying chamber through the permeable membrane 122. After the lyophilization has been completed, the retaining members 26 of all of the closure assemblies 22 can be pressed downward, e.g., pressure applied to the upper tray 112, to cause the closure members to snap into sealing engagement with their associated vials like shown in FIG. 6 and described above. For example, at the end of the drying cycle, shelves upon which the freeze drying of the vials in the tray(s) has/have taken place collapse pushing down on the tops of the stoppers on the shelf below them. This force is now applied to the Gore-tex® membrane 122 on the top of the tray. The cover member 112 holding the closure assemblies 22 in place over the vials collapses due to the flexing of the "V" shaped outer edge 116 and each closure assembly is snapped into place onto sealing engagement with the neck of its associated vial. In this process all of the products are kept within a controlled sterile environment. The trays with the sealed vials can now be removed from the freeze dryer and the trays opened in a non-sterile environment without fear of contamination.

Since the closure assembly 22 of this invention compresses the elastomeric stopper 24, the sealed vials can be moved out of sterile conditions (European grade A or U.S. class 100) for additional processing steps and the application of an outer security seal, e.g., a locking cap member 28 (which will be described shortly). Thus, the closure assembly of this invention allows a manufacturer to utilize tray filling and processing of injectable drugs. In this process, pre-sterilized vials are provided to the filling company in trays.

The closure assemblies of this invention can be used in various ways. For example, they can be sold in bulk to a company that is filling liquids. In such a case the closure assemblies would be applied to vials as they now apply just the stopper to vials. The advantage of the closure assemblies of this invention for that application is that the stopper is compressed and the package is secure at the stoppering station, which does not now occur with the prior art. A second way that closure assemblies of this invention can be used is to provide them in bulk to a company that would use them in freeze drying. In such an application the closure assemblies would be inserted into the vials into the "up" position (the position shown in FIG. 5) and then the vials with their respective closure assemblies transported to a freeze drier. The advantage of that approach is that the stopper would be locked into a more exact position than occurs in the prior art which depends on the sliding surface of the stopper and the glass neck. A third way that closure assemblies constructed in accordance with this invention could be used is to be provided pre-applied in the up position within the tray assemblies constructed as discussed above.

As mentioned earlier the standard prior art stopper and vial combinations often rely on a feature called a blowback on the inside of the lip of the glass finish of the vial to mate with an indentation on the elastomeric stopper to keep the stoppered vials from raising up during processing. Since the closure assembly of this invention locks on to the outside of the neck of the vial, the blowback feature of the prior art can be eliminated. Moreover the manner in which the closure assembly of the subject invention locks to the outside of the vial provides a security benefit when using vials manufactured from thermoplastic materials that cannot include a blowback feature.

While the seal produced by the operation of the closure assembly of this invention is suitable for keeping the contents of the vial sterile for at least short period of time, for many applications a more permanent seal would be deemed necessary. In such a case the locking cap member 28 forming another part of the capping system of this invention is used to permanently lock the closure assembly in place on the vial. This process will best be understood by reference to FIGS. 12-18. In that arrangement the capping system 20 consists of the heretofore identified and discussed closure assembly 22 and the locking cap member 28. The closure assembly 22 and the locking cap member 28 can be preassembled as shown in FIGS. 12 and 14-18 so that the entire assembly can be placed on a vial to be sealed at one time (although the sealing steps would be carried out sequentially as will be described later). Alternatively, the locking cap member 28 can be applied onto a vial that has already been temporarily sealed by a closure assembly 22.

In the interest of brevity the details of the closure assembly 22 will not be reiterated. Turning now to FIGS. 14 and 15 it can be seen that the locking cap member is a generally cup shaped member that can be formed of any suitable plastic material, e.g., polypropylene, that is sufficiently strong, yet having some flexibility (for reasons to become apparent soon). The member 28 can be molded as an integral unit and basically comprises a top wall 28A and a peripheral sidewall 28B. The center portion of the top wall is open at 28C to provide access for a needle or some other piercing instrument to pierce through the stopper 24. As best seen in FIG. 15 at a plurality of internal lugs 28D projects inward from the inner surface of the sidewall 28B. The lugs 28D are located slightly above the bottom edge of the member 28.

The locking cap member 28 is disposed on the top of the retainer member 26 so that the undersurface of each of the lugs 28D abuts a respective portion of the top wall 26A of the retaining member as shown in FIG. 16. A force can be applied through the opening 28C of the locking cap onto the top of the retainer member 26 to cause that member to move down with respect to the vial from its "up" position like shown in FIG. 16 (and in FIG. 5) to the "down" or temporary sealing position like shown in FIG. 17 (and in FIG. 5). At this point the stopper 24 will be compressed and locked in place onto the neck of the vial by the inwardly projecting lugs 26F engaging the undersurface 14 of the lip of the vial 2 as described earlier. The locking cap 28, however, will still be in its up position as shown in FIG. 17. In order to permanently seal the vial, all that is required is to apply a downward force onto the locking cap 28 to cause it to move to the down position shown in FIG. 18, whereupon its inwardly projecting lugs 28D provide an inwardly directed force on the fingers 26E of the retainer member 26, thereby ensuring that the inner closure assembly 22 is tightly held against the neck of the vial. Thus, with the arrangement as just described the final (permanent) sealing operation can take place in one motion where the inner sterility seal formed by the closure assembly 22 snaps into place first on the neck of the vial, followed by the motion of the outer locking cap to effect the final permanent seal.

As should be appreciated from the foregoing the system of this invention is unique in that it includes an elastomeric element pre-inserted into it. This element can either be a molded stopper, where a customer wants to work with an already approved formulation that has been filed with the regulatory agencies. In fact, the elastomeric stopper can be simplified to a flat disc that is either molded or punched directly out of sheeting material. When used on liquid filled products, the inner sterility seal would be applied in one step with the sterile filling suite. When working with a material that will be lyophilized, the inner seal would be applied halfway and locked into position to be transported to the freeze drier.

Moreover, the system of this invention should prove of immense value to the pharmaceutical industry for filling vials and syringe cartridges in trays. With the elastomer inserted into it, it can be assembled into the lid of a tray to mate with vials or cartridges nested in the bottom half of the tray. In this application the entire tray would be sealed at one time keeping all of the containers intact in one tray. This same technique can be used with vials that will be lyophilized. In this case, the tray itself can be manufactured with a side panel that includes a permeable, e.g., Gore-tex® membrane, section instead of using a membrane cover sheet such as described with reference to FIG. 11. The filled tray with inner seals applied to the vials half way and the tray will then be sealed while it is still in the sterile environment. It would be transported to the freeze drier and placed on the shelves of the drier. At the completion of the drying cycle the shelves of the drier would collapse and the flexible Gore-tex® material allows for sealing the entire tray to its final sterile condition before exiting from the drier.

Another feature of the system of this invention is that it enables one to provide clear evidence of tampering. In particular, the outer locking cap 28 may be formed to be clear or translucent or have a portion or window that is clear or translucent so that a lot number or other identification can be etched or printed on the retainer member 24 of the inner closure assembly 22. Thus, the lot number or other identification indicia can be read through the seal, but not be able to be altered in any way.

The closure assembly forming the inner seal of this invention can also be used with other manufacturer's devices. For example, the BD Monovial could be modified so that it could be used as the outer locking seal and applied in a final packaging area. This could also apply to other needle-less access systems or other docking devices.

Since the elastomeric stopper element 24 of this invention is housed in a plastic closure (i.e., the retaining member 26), lubricants such as silicone that have been required heretofore to track stoppers may be eliminated.

It should also be pointed out that the subject invention can be used for liquid fills, as well as freeze dried applications, allowing the closed container to leave a sterile environment with proven seal integrity and be handled in a non-classified environment. It could be made available in various finish sizes and the outer locking seal could be designed to fit with a variety of devices for administration.

Without further elaboration the foregoing will so fully illustrate our invention that others may, by applying current or future knowledge, adopt the same for use under various conditions of service.

We claim:

1. A method for capping plural pharmaceutical vials in a lyophilization process with a plurality of closures, each of said vials including an interior in which a lyophilizable pharmaceutical is located, each of said vials having an opening to said interior thereof and a flanged neck surrounding said opening, said flanged neck having an undersurface, said method comprising:

providing a plurality of said vials in a spaced array in a tray, said tray having a flange;

providing a plurality of closures in respective recesses in a cover member, said recesses being in an array corresponding to said spaced array of said tray, each of said closures comprising a respective elastomeric stopper and a retainer member;

disposing said cover member with said closures over said vials in said tray, whereupon each of said closures is located on the neck of its associated vial so that a portion of said stopper closes, but does not seal, said opening of said vial;

securing a waterproof/breathable membrane to said peripheral flange of said tray, to enclose said cover member and said vials with their respective closures within said tray to thereby form a unit for processing;

placing said unit in a freeze drying chamber to lyophilize the contents of said vials, whereupon moisture is extracted from within said vials and passes through said membrane out of said unit;

thereafter applying a force to said cover member of said unit to apply said force to said closures within said tray to cause each of said retainer members to snap-fit on said flanged neck of its associated vial so that portions of the associated stopper seal said opening in the associated vial; and removing said unit vials from the freeze drying chamber.

2. The method of claim 1 wherein each of said retainer members comprises a top wall and a peripheral sidewall, said sidewall comprising plural resilient fingers located about the periphery of said sidewall, said fingers of said retainer member being arranged to flex over said flanged neck of said vial when said force is applied to said closures, whereupon said fingers then snap into engagement with the undersurface of the flanged neck of said vial and with portions of said top wall of said retainer member in engagement with portions of said stopper to hold said stopper in place on said vial to seal said opening in said vial.

3. The method of claim 2 wherein each of said retainer members comprises a top wall and a peripheral sidewall, said sidewall having plural slots enabling moisture from within said vials to pass therethrough during the lyophilization of the contents of said vials.

4. The method of claim 3 wherein said plural slots are located between adjacent fingers of said sidewall.

5. The method of claim 1 wherein said vials are taken to a location for further processing.

6. The method of claim 5 wherein said further processing comprises securing a locking member over the closures to form a permanent seal for said vials.

7. The method of claim 1 wherein said membrane comprises Gore-tex® fabric.

8. The method of claim 1 wherein said cover member includes a V-shaped outer edge which is disposed on a portion of said tray and which collapses when said force is applied to said cover member.

9. The method of claim 1 comprising stacking plural of said units within said freeze drying chamber.

10. The method of claim 9 comprising applying a force to said stacked units at one time whereupon a force is applied to the cover member of each of said stacked units.

* * * * *